US010954476B2

(12) United States Patent
Stokes et al.

(10) Patent No.: US 10,954,476 B2
(45) **Date of Patent: *Mar. 23, 2021**

(54) ALKALINE CLEANING COMPOSITION AND METHODS FOR REMOVING LIPSTICK

(71) Applicant: Ecolab USA Inc., Saint Paul, MN (US)

(72) Inventors: Jennifer Stokes, Saint Paul, MN (US); Carter M. Silvernail, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 66 days.

This patent is subject to a terminal disclaimer.

(21) Appl. No.: 16/183,537

(22) Filed: Nov. 7, 2018

(65) Prior Publication Data

US 2019/0136155 A1 May 9, 2019

Related U.S. Application Data

(60) Provisional application No. 62/582,652, filed on Nov. 7, 2017.

(51) Int. Cl.
*C11D 1/00* (2006.01)
*C11D 3/04* (2006.01)
(Continued)

(52) U.S. Cl.
CPC ..... *C11D 3/30* (2013.01); *C11D 1/72* (2013.01); *C11D 1/722* (2013.01); *C11D 3/044* (2013.01);
(Continued)

(58) Field of Classification Search
CPC .. C11D 1/72; C11D 1/722; C11D 3/08; C11D 3/10; C11D 3/044; C11D 3/30; C11D 3/33; D06L 1/12
(Continued)

(56) References Cited

U.S. PATENT DOCUMENTS 4,347,168 A 8/1982 Murphy et al.
4,698,167 A 10/1987 Burckett St Laurent et al.
(Continued)

FOREIGN PATENT DOCUMENTS

EP 0946703 B1 4/2002
EP 1049374 B1 4/2003
(Continued)

OTHER PUBLICATIONS

Ecolab USA Inc., PCT/US2018/059554 filed Nov. 7, 2018, "The International Search Report and Written Opinion of the International Searching Authority, or the Declaration", 13 pages, dated Jan. 31, 2019.

(Continued)

*Primary Examiner* — Gregory R Delcotto
(74) *Attorney, Agent, or Firm* — McKee, Voorhees & Sease, PLC

(57) ABSTRACT

Methods of cleaning waxy, oily and/or greasy soils, including lipsticks and lip gloss, are disclosed. Methods of removing lipstick and lip gloss stains in warewash and laundry applications are disclosed through application of cleaning compositions comprising long chain polyamines, namely C6-C20 polyamines having between 1 and 5 nitrogens. In some aspects alkaline cleaning compositions comprise sodium hydroxide detergents and a C6-C20 polyamines such as N1-(3-aminopropyl)-N3-dodecylpropane-1,3,diamine) and/or N1,N1,N3-tris(3-aminopropyl)-N3-dodecylpropane-1,3-diamine.

19 Claims, 6 Drawing Sheets
(3 of 6 Drawing Sheet(s) Filed in Color)

(51) Int. Cl.

| | |
|---|---|
| ***C11D 3/30*** | (2006.01) |
| ***C11D 1/722*** | (2006.01) |
| ***C11D 1/72*** | (2006.01) |
| ***C11D 7/32*** | (2006.01) |
| ***C11D 3/37*** | (2006.01) |
| ***C11D 3/10*** | (2006.01) |
| ***C11D 3/33*** | (2006.01) |
| ***C11D 3/08*** | (2006.01) |
| ***D06L 1/12*** | (2006.01) |

(52) U.S. Cl.
CPC ..... *C11D 3/08* (2013.01); *C11D 3/10* (2013.01); *C11D 3/33* (2013.01); *C11D 3/3723* (2013.01); *C11D 7/3209* (2013.01); *D06L 1/12* (2013.01)

(58) Field of Classification Search
USPC ..... 510/303, 321, 356, 480, 499, 505, 506; 8/137
See application file for complete search history.

(56) References Cited

U.S. PATENT DOCUMENTS

| | | | | |
|---|---|---|---|---|
| 4,846,990 | A | 7/1989 | Upadek et al. | |
| 5,205,960 | A | 4/1993 | Kristopeit et al. | |
| 5,276,047 | A | 1/1994 | Eggensperger et al. | |
| 6,054,139 | A | 4/2000 | Lambert et al. | |
| 6,172,028 | B1 * | 1/2001 | Baur | C11D 1/40 510/336 |
| 8,372,336 | B2 | 2/2013 | Hellberg et al. | |
| 8,894,927 | B2 * | 11/2014 | Finch | A01N 33/04 422/28 |
| 8,906,839 | B2 | 12/2014 | Lentsch et al. | |
| 10,433,545 | B2 * | 10/2019 | Karandikar | A61L 2/18 |
| 2002/0119902 | A1 * | 8/2002 | Harrison | C11D 1/83 510/424 |
| 2004/0171504 | A1 * | 9/2004 | Clarke | C11D 3/30 510/221 |
| 2006/0019863 | A1 | 1/2006 | Hubig et al. | |
| 2013/0042887 | A1 * | 2/2013 | Avery | C11D 11/0023 134/2 |
| 2013/0196893 | A1 * | 8/2013 | Busby | C11D 3/43 510/499 |
| 2014/0130267 | A1 | 5/2014 | Tangestani-Nejad et al. | |
| 2014/0274854 | A1 * | 9/2014 | Ortmann | C11D 3/38636 510/195 |
| 2017/0015945 | A1 * | 1/2017 | Larson | C11D 3/2068 |
| 2017/0275569 | A1 * | 9/2017 | Pegelow | C11D 3/38618 |
| 2017/0306264 | A1 * | 10/2017 | Peggau | C11D 1/825 |
| 2018/0132481 | A1 * | 5/2018 | Jiang | A01N 25/02 |
| 2019/0373886 | A1 * | 12/2019 | Karandikar | A61L 2/18 |

FOREIGN PATENT DOCUMENTS

| | | | |
|---|---|---|---|
| EP | 2578083 | A1 | 4/2013 |
| EP | 2940112 | A1 | 11/2015 |
| JP | 2009013336 | A | 1/2009 |
| JP | 5481714 | B2 | 4/2014 |
| WO | 2006041704 | A1 | 4/2006 |

OTHER PUBLICATIONS

Ecolab USA Inc., PCT/US2018/059580 filed Nov. 7, 2018, "The International Search Report and Written Opinion of the International Searching Authority, or the Declaration", 13 pages, dated Jan. 31, 2019.

Singh et al., "A Search for Ecofriendly Detergent/Dispersant Additives for Vegetable-Oil Based Lubricants", J Surfact Deterg, 15, pp. 399-409, 2012.

* cited by examiner

ALKALINE CLEANING COMPOSITION AND METHODS FOR REMOVING LIPSTICK

CROSS-REFERENCE TO RELATED APPLICATIONS

This application claims priority under 35 U.S.C. § 119 to provisional application Ser. No. 62/582,652, filed Nov. 7, 2017, herein incorporated by reference in its entirety.

FIELD OF THE INVENTION

The invention relates to methods of cleaning waxy, oily and/or greasy soils, including lip cosmetic soils such as lipsticks and lip gloss. In particular, the removal of lip cosmetic soils including lipstick and lip gloss stains in warewash, pretreatment and hard surface cleaning are disclosed through application of solid and/or liquid cleaning compositions comprising long chain polyamines, namely C6-C20 polyamines having between 1 and 5 nitrogens with or without alkalinity sources. Preferred alkaline cleaning compositions comprise sodium hydroxide detergents comprising N1-(3-aminopropyl)-N3-dodecylpropane-1,3,diamine) and/or N1,N1,N3-tris(3-aminopropyl)-N3-dodecylpropane-1,3-diamine.

BACKGROUND OF THE INVENTION

Various ware, including drinkware in restaurants and bars are often soiled at the top portion of the drinkware from lip cosmetic soils that rub off a patron's lips and onto the drinkware as the patron drinks out of the glass. The lip cosmetic soil is typically very difficult to remove because of the waxy, oily and/or greasy consistency of lip cosmetics. Recently, lip cosmetic soils have become even more difficult to remove as a result of advances in the lip cosmetic industry such as new "long-wearing" lipsticks.

In the past, drinkware have been run through various washing processes depending on the particular method used. Pretreatments or soaking have been employed to remove lip cosmetic soils or at last loosen the soils prior to running the drinkware through a normal wash cycle. Often these pretreatments require inverting the ware to contact the soil. Additional processes include, for example, rewashing the ware, manually washing or polishing the ware, and/or adding additional time to the warewash cycle to remove such soils.

Warewashing formulations employing alkali metal carbonates, alkali metal metasilicates, alkali metal silicates, and/or alkali metal hydroxides are known to provide effective detergency, particularly when used with phosphorus-containing compounds. However, the use of phosphorous raw materials in detergents has become undesirable for a variety of reasons, including environmental reasons. This has resulted in heavy regulation of phosphorus based chemistries. Thus, industries are seeking alternative ways to clean wares and control hard water scale formation associated with highly alkaline detergents. Many commercially-available detergent formulations have employed sodium tripolyphosphate as a cost effective component for controlling hard water scale and providing detergency. However, as formulations are adapted to contain less than 0.5 wt-% phosphorus, there is a need for identifying replacement cleaning components. Many non-phosphate replacement formulations result in heavy soil accumulation on hard surfaces.

Accordingly, it is an objective to develop improved solid and/or liquid cleaning compositions for the effectively removal of waxy, oily and/or greasy soils, including lip cosmetic soils.

A further object is to provide improved warewash, pretreatment and hard surface cleaning compositions.

A further object is to provide cleaning compositions that do not require the use of a pretreatment step to soak the lip cosmetic soils on drinkware.

A further object is to provide efficient methods of using such cleaning composition.

Other objects, advantages and features of the present invention will become apparent from the following specification taken in conjunction with the accompanying drawings.

BRIEF SUMMARY OF THE INVENTION

An advantage of the compositions and methods are the formulations substantially free of phosphorus and still provide effective detergency for lip cosmetic soils. The solid and/or liquid cleaning compositions include long chain polyamines, namely C6-C20 polyamines having between 1 and 5 nitrogens. The cleaning compositions can include or exclude alkalinity sources. Preferred alkaline cleaning compositions comprise sodium hydroxide detergents comprising N1-(3-aminopropyl)-N3-dodecylpropane-1,3,diamine) and/or N1,N1,N3-tris(3-aminopropyl)-N3-dodecylpropane-1,3-diamine. Beneficially, the compositions are suitable for warewash, pretreatment and hard surface cleaning applications.

In an embodiment, a cleaning composition comprises: an optional alkalinity source, wherein if the alkalinity source is included is an alkali metal hydroxide, alkali metal carbonate, alkali metal silicate, and/or an organic nitrogen base; at least of a cleaning and/or defoaming surfactant, solvent, polymer/chelant, and/or enzyme; and a C6-C20 long chain polyamine.

In an embodiment, a cleaning composition comprises: an optional alkali metal hydroxide; a C6-C20 long chain polyamines; defoaming surfactant; and water.

In an embodiment, methods of removing waxy, oily and/or greasy soils comprise: providing ware with a waxy, oily and/or greasy soil; placing the ware in contact with the cleaning composition as described herein; and washing the ware.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Figure 1A:
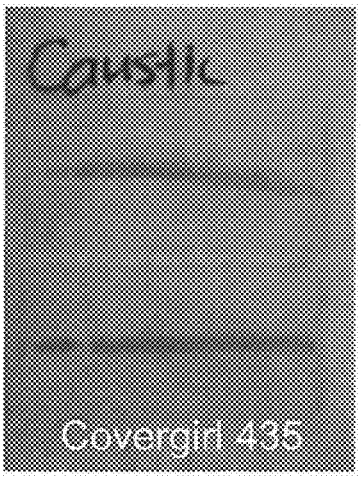
FIG. 1(A-C) shows images from Example 1 of glass slides after treatment with Formula A wherein no removal of lipstick pigment or wax was observed.
Figure 1B:
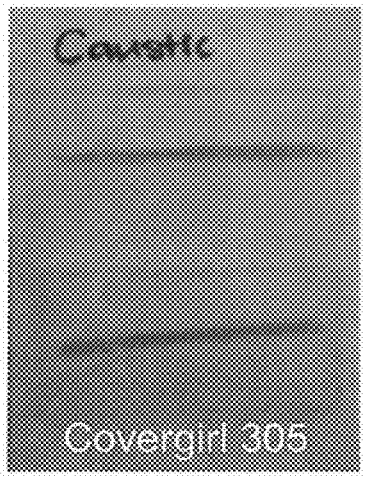
Figure 1C:
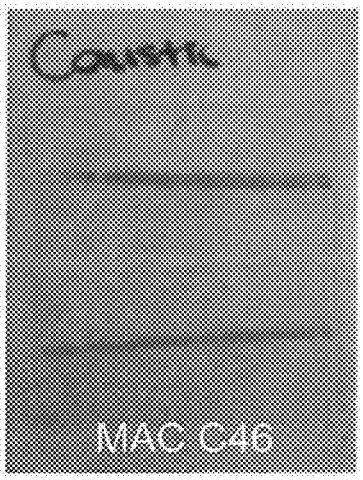
Figure 2A:
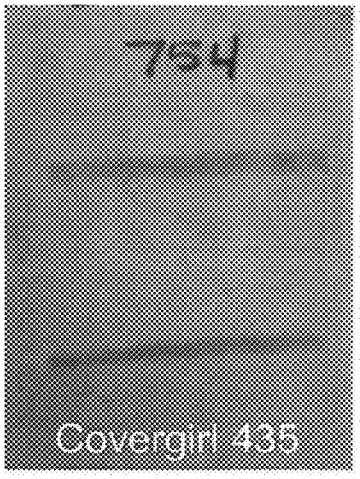
FIG. 2(A-C) shows images from Example 1 of glass slides after treatment with Formula D wherein no removal of lipstick pigment or wax was observed.
Figure 2B:
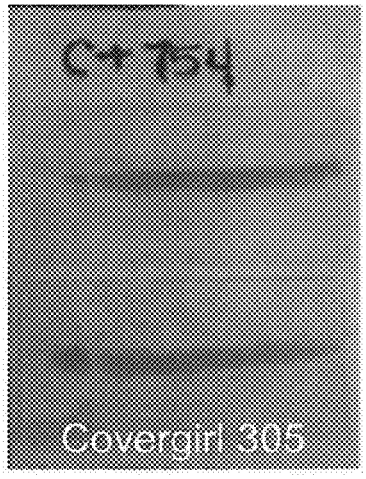
Figure 2C:
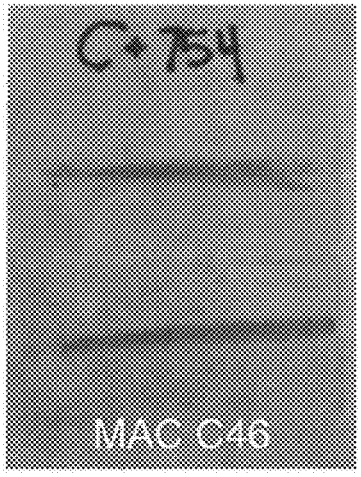
Figure 3A:
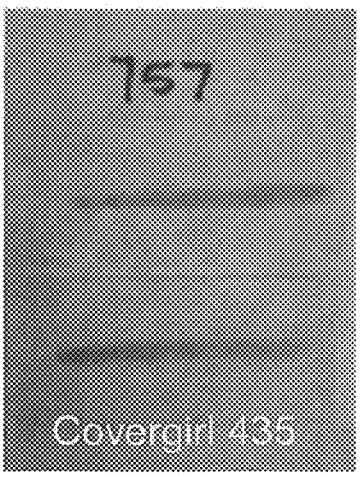
FIG. 3(A-C) shows images from Example 1 of glass slides after treatment with Formula E wherein no removal of lipstick pigment or wax was observed.
Figure 3B:
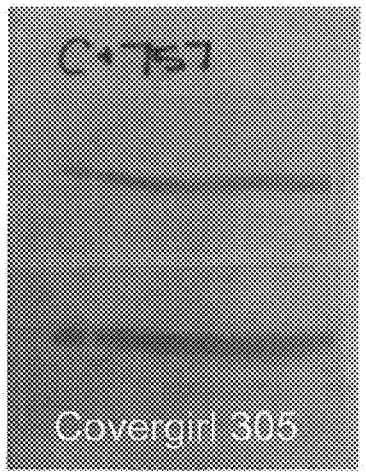
Figure 3C:
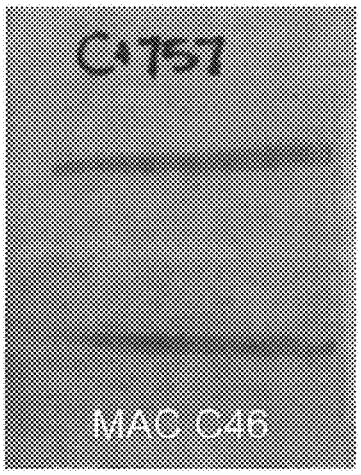

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

Methods of cleaning waxy, oily and/or greasy soils, including lip cosmetic soils such as lipsticks and lip gloss are provided and have many advantages over conventional cleaning compositions for removing such soils. In particular, the removal of lip cosmetic soils including lipstick and lip gloss stains in warewash applications is beneficially achieved through use of cleaning compositions comprising long chain polyamines, namely C6-C20 polyamines having between 1 and 5 nitrogens.

The embodiments are not limited to particular methods of employing the cleaning compositions, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "antiredeposition agent" refers to a compound that helps keep suspended in water instead of redepositing onto the object being cleaned. Antiredeposition agents are useful in the present invention to assist in reducing redepositing of the removed soil onto the surface being cleaned.

As used herein, the term "cleaning" refers to a method used to facilitate or aid in soil removal, bleaching, microbial population reduction, rinsing, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

The term "commercially acceptable cleaning performance" refers generally to the degree of cleanliness, extent of effort, or both that a typical consumer would expect to achieve or expend when using a cleaning product or cleaning system to address a typical soiling condition on a typical substrate. This degree of cleanliness may, depending on the particular cleaning product and particular substrate, correspond to a general absence of visible soils, or to some lesser degree of cleanliness. Cleanliness may be evaluated in a variety of ways depending on the particular cleaning product being used (e.g., ware detergent) and the particular hard or soft surface being cleaned (e.g., ware and the like), and normally may be determined using generally agreed industry standard tests or localized variations of such tests. In the absence of such agreed industry standard tests, cleanliness may be evaluated using the test or tests already employed by a manufacturer or seller to evaluate the cleaning performance of its phosphorus-containing cleaning products sold in association with its brand.

The term "drinkware" includes a variety of materials used to make a drinking container including glass, china, ceramic, plastic, porcelain, Corelleware, Melmac, stoneware, copper, aluminum, acrylic, stainless steel, chrome, crystal, melamine and the like. The term "drinkware" refers to any drinking container and includes for example high ball glasses, low ball glasses, wine glasses, mugs, teacups, pint glasses, shot glasses, martini glasses, snifters, pilsner glasses, champagne flutes, water glasses, and the like.

The term "improved cleaning performance" refers generally to achievement by a substitute cleaning product or substitute cleaning system of a generally greater degree of cleanliness or with generally a reduced expenditure of effort, or both, when using the substitute cleaning product or substitute cleaning system rather than a branded phosphorus-containing cleaning product to address a typical soiling condition on a typical substrate. This degree of cleanliness may, depending on the particular cleaning product and particular substrate, correspond to a general absence of visible soils, or to some lesser degree of cleanliness, as explained above.

The terms "include" and "including" when used in reference to a list of materials refer to but are not limited to the materials so listed.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt %.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

As used herein, the term "soil" refers to polar or non-polar organic or inorganic substances including, but not limited to carbohydrates, proteins, fats, oils and the like. These substances may be present in their organic state or complexed to a metal to form an inorganic complex. Soils are also referring to the more specific lip cosmetic soils described herein.

The term "solid" refers to a composition in a generally shape-stable form under expected storage conditions, for example a powder, particle, agglomerate, flake, granule, pellet, tablet, lozenge, puck, briquette, brick or block, and whether in a unit dose or a portion from which measured unit doses may be withdrawn. A solid may have varying degrees of shape stability, but typically will not flow perceptibly and will substantially retain its shape under moderate stress, pressure or mere gravity, as for example, when a molded solid is removed from a mold, when an extruded solid exits an extruder, and the like. A solid may have varying degrees of surface hardness, and for example may range from that of a fused solid block whose surface is relatively dense and hard, resembling concrete, to a consistency characterized as being malleable and sponge-like, resembling a cured caulking material.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

As used herein, the term "ware" refers to items such as eating and cooking utensils, dishes, glasses and other hard surfaces. As used herein, the term "warewashing" refers to washing, cleaning, or rinsing ware. The term "ware" generally refers to items such as eating and cooking utensils, dishes, glasses and other hard surfaces. Ware also refers to items made of various substrates, including glass, ceramic, china, crystal, metal, melamine plastic or natural substances such, but not limited to clay, bamboo, hemp and the like. Types of plastics that can be cleaned with the compositions according to the invention include but are not limited to, those that include polypropylene (PP), high density polyethylene (HDPE), low density polyethylene (LDPE), polyvinyl chloride (PVC), syrene acrylonitrile (SAN), polycarbonate (PC), melamine formaldehyde resins or melamine resin (melamine), acrilonitrile-butadiene-styrene (ABS), and polysulfone (PS). Other exemplary plastics that can be cleaned using the compounds and compositions of the invention include polyethylene terephthalate (PET) polystyrene polyamide.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Cleaning Compositions

EMBODIMENTS

Exemplary ranges of the detergent compositions are shown in Tables 1A-1E in weight percentage of the solid and/or liquid detergent compositions, including both concentrate and ready-to-use compositions for various applications of use.

TABLE 1A

[Multi-use formulations]

| Material | First Exemplary Range wt-% | Second Exemplary Range wt-% | Third Exemplary Range wt-% | Fourth Exemplary Range wt-% |
|---|---|---|---|---|
| Alkalinity Source(s) | 0-99 | 0.005-95 | 0.01-90 | 0.015-90 |
| Long chain polyamine | 0.0005-50 | 0.001-30 | 0.005-20 | 0.01-10 |
| Additional Functional Ingredients | 0-25 | 0-20 | 0-10 | 0-5 |

TABLE 1B

| Material | First Exemplary Range wt-% | Second Exemplary Range wt-% | Third Exemplary Range wt-% | Fourth Exemplary Range wt-% |
|---|---|---|---|---|
| Alkalinity Source(s) | 0-99 | 0.005-95 | 0.01-90 | 0.015-85 |
| Long chain polyamine | 0.0005-50 | 0.001-30 | 0.005-20 | 0.01-10 |

TABLE 1B-continued

| Material | First Exemplary Range wt-% | Second Exemplary Range wt-% | Third Exemplary Range wt-% | Fourth Exemplary Range wt-% |
|---|---|---|---|---|
| Surfactant (cleaning and/or defoaming) | 0-30 | 0.001-30 | 0.005-30 | 0.01-15 |
| Additional Functional Ingredients | 0-25 | 0-20 | 0-10 | 0-5 |

TABLE 1C

[Hard Surface and/or Pretreatment Compositions]

| Material | First Exemplary Range wt-% | Second Exemplary Range wt-% | Third Exemplary Range wt-% |
|---|---|---|---|
| Alkalinity Source(s) | 0.01-99 | 0.01-90 | 0.01-80 |
| Long chain polyamine | 0.001-25 | 0.001-15 | 0.001-10 |
| Surfactant (cleaning and/or defoaming) | 0-25 | 0.001-15 | 0.001-10 |
| Solvent | 0-40 | 0.005-30 | 0.005-20 |
| Water Conditioning Agents | 0-20 | 0.0005-15 | 0.001-10 |
| Water | 0-99 | 0.1-85 | 0.1-75 |
| Additional Functional Ingredients | 0-25 | 0.0001-15 | 0.0001-10 |

TABLE 1D

[Machine dishwashing and warewashing detergent Compositions]

| Material | First Exemplary Range wt-% | Second Exemplary Range wt-% | Third Exemplary Range wt-% |
|---|---|---|---|
| Alkalinity Source(s) | 0-99 | 0.1-85 | 5-80 |
| Long chain polyamine | 0.1-25 | 0.5-15 | 0.5-10 |
| Surfactant (cleaning and/or defoaming) | 0-25 | 0.5-15 | 0.5-10 |
| Water Conditioning Agents | 0-30 | 0.5-20 | 1-15 |
| Enzyme | 0-25 | 0.0005-15 | 0.001-10 |
| Oxidizer | 0-45 | 0.5-35 | 0.5-25 |
| Water | 0-99 | 0.1-85 | 0.1-75 |
| Additional Functional Ingredients | 0.0001-25 | 0.0001-15 | 0.0001-10 |

TABLE 1E

[Manual Pot and Pan Presoak Compositions]

| Material | First Exemplary Range wt-% | Second Exemplary Range wt-% | Third Exemplary Range wt-% |
|---|---|---|---|
| Alkalinity Source(s) | 0-99 | 0.1-85 | 5-80 |
| Long chain polyamine | 0.1-25 | 0.5-15 | 0.5-10 |
| Surfactant (cleaning and/or defoaming) | 0-75 | 0.5-50 | 0.5-25 |
| Water Conditioning Agents | 0-30 | 0.5-20 | 1-15 |
| Enzyme | 0-25 | 0.0005-15 | 0.001-10 |
| Water | 0-99 | 0.1-85 | 0.1-75 |
| Additional Functional Ingredients | 0-25 | 0.0001-15 | 0.0001-10 |

The cleaning compositions may include concentrate solids and/or liquid compositions or may be diluted to form use compositions, as well as ready-to-use compositions. In general, a concentrate refers to a composition that is intended to be diluted with water to provide a use solution that contacts an object to provide the desired cleaning, rinsing, or the like. The cleaning composition that contacts the articles or wares to be washed can be referred to as a concentrate or a use composition (or use solution) dependent upon the formulation employed in methods. It should be understood that the concentration of the long chain polyamine and other components will vary depending on whether the cleaning composition is provided as a concentrate or as a use solution.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water.

In an aspect, a use solution of the cleaning composition has between about 0 ppm to about 2000 ppm alkalinity (as some embodiments of the compositions do not require an alkalinity source for removal of the lipstick soils) and between about 10 ppm to about 250 ppm long chain polyamine. In a preferred aspect, a use solution of the cleaning composition has between about 100 ppm to about 2000 ppm alkalinity and between about 10 ppm to about 200 ppm long chain polyamine. In a preferred aspect, a use solution of the cleaning composition has between about 500 ppm to about 1500 ppm alkalinity and between about 100 ppm to about 200 ppm long chain polyamine. In a preferred aspect, a use solution of the cleaning composition has between about 750 ppm to about 1250 ppm alkalinity and between about 100 ppm to about 200 ppm long chain polyamine. In addition, without being limited according to the invention, all ranges recited are inclusive of the numbers defining the range and include each integer within the defined range.

Alkalinity Source

In some aspects, the compositions include an effective amount of one or more alkalinity sources. In other aspects, the compositions do not include an alkalinity source and unexpectedly can provide effective soil removal. In compositions employing an alkalinity source, an effective amount of one or more alkaline sources should be considered as an amount that provides a composition having a pH between about 7 and about 14. In a particular embodiment the cleaning composition will have a pH of between about 7.5 and about 13.5. In a particular embodiment the cleaning composition will have a pH of between about 8 and about 13. During the wash cycle the use solution will have a pH between about 8 and about 13. In particular embodiments, the use solution will have a pH between about 9 and 11. Examples of suitable alkaline sources of the cleaning composition include, but are not limited to carbonate-based alkalinity sources, including, for example, carbonate salts such as alkali metal carbonates; caustic-based alkalinity sources, including, for example, alkali metal hydroxides; other suitable alkalinity sources may include metal silicate, metal borate, and organic alkalinity sources. Exemplary alkali metal carbonates that can be used include, but are not limited to, sodium carbonate, potassium carbonate, bicarbonate, sesquicarbonate, and mixtures thereof. Exemplary alkali metal hydroxides that can be used include, but are not limited to sodium, lithium, or potassium hydroxide. Exemplary metal silicates that can be used include, but are not limited to, sodium or potassium silicate or metasilicate. Exemplary metal borates include, but are not limited to, sodium or potassium borate.

Organic alkalinity sources are often strong nitrogen bases including, for example, ammonia (ammonium hydroxide), amines, alkanolamines, and amino alcohols. Typical examples of amines include primary, secondary or tertiary amines and diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups. Typical examples of alkanolamines include monoethanolamine, monopropanolamine, diethanolamine, dipropanolamine, triethanolamine, tripropanolamine and the like. Typical examples of amino alcohols include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like.

In general, alkalinity sources are commonly available in either aqueous or powdered form, either of which is useful in formulating the present detergent compositions. The alkalinity may be added to the composition in any form known in the art, including as solid beads, granulated or particulate form, dissolved in an aqueous solution, or a combination thereof.

In general, it is expected that the cleaning compositions will include the alkalinity source(s) in an amount between about 0% and about 99% by weight, between about 0.005% and about 95% by weight, between about 0.01% and about 90% by weight, between about 0.015% and about 90% by weight, between about 10% and about 90% by weight, between about 20% and about 90% by weight, between about 40% and about 90% by weight, between about 50% and about 90% by weight, and between about 50% and about 85% by weight of the total weight of the detergent composition. When diluted to a use solution, the compositions of the present invention can include between about 0 ppm and about 4000 ppm of an alkalinity source, between about 10 ppm and about 4000 ppm of an alkalinity source, preferably between about 100 ppm and about 1500 ppm, most preferably between about 100 ppm and 1000 ppm. In addition, without being limited according to the invention, all ranges recited are inclusive of the numbers defining the range and include each integer within the defined range.

Long Chain Polyamines

The compositions include an effective amount of one or more long chain polyamines. As referred to herein, long chain polyamines include C6-C20 amines, preferably C6-C18 polyamines, preferably C6-C12 polyamines, preferably C12-C20 polyamines, preferably C12-C18 polyamines, or preferably C18-C20 polyamines. The long chain polyamines suitable for use in the compositions can be branched or unbranched. In a preferred aspect, the long chain polyamines suitable for use in the compositions are unbranched, straight chain amines without any aromatic functional groups in the structure. In a preferred aspect, the long chain polyamines suitable for use in the compositions are unbranched, straight chain amines having between 1 and 5 nitrogens.

Exemplary C6-C20 polyamines include N1-(3-aminopropyl)-N3-dodecylpropane-1,3,diamine) [I] and N1,N1,N3-tris(3-aminopropyl)-N3-dodecylpropane-1,3-diamine [II] having the respective formulas as shown below.

[I]

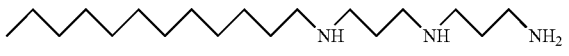

[II]

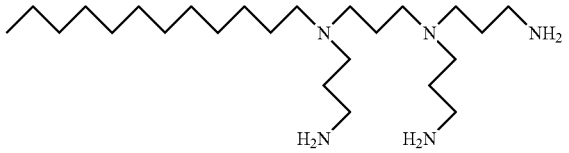

In an aspect, the compositions include from about 0.0005 wt-% to about 99 wt-% long chain polyamines, from about 0.0005 wt-% to about 50 wt-% long chain polyamines, from about 0.001 wt-% to about 30 wt-% long chain polyamines, from about 0.005 wt-% to about 20 wt-% long chain polyamines, from about 0.01 wt-% to about 10 wt-% long chain polyamines, from about 1 wt-% to about 30 wt-% long chain polyamines, from about 1 wt-% to about 20 wt-% long chain polyamines, or preferably from about 0.1 wt-% to about 10 wt-% long chain polyamines. In addition, without being limited according to the invention, all ranges recited are inclusive of the numbers defining the range and include each integer within the defined range.

In cleaning compositions containing an alkalinity source or without an alkalinity source, the composition has at least a neutral to alkaline pH to provide the alkaline cleaning composition. The alkaline cleaning composition does not include an acid or acidulant, including for example phosphorus based acids. As a result, the long chain polyamines in the alkaline cleaning composition are not neutralized amines, meaning they are not cationic polyamines.

Defoaming Surfactant

The components of the cleaning compositions can further include a defoaming surfactant. Exemplary defoaming surfactants include alkoxylated nonionic surfactants, polyoxypropylene-polyoxyethylene polymeric compounds and reverse polyoxypropylene-polyoxyethylene polymeric compounds.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Block polyoxypropylene-polyoxyethylene polymeric compounds which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants.

In an aspect, the compositions include from about 0 wt-% to about 30 wt-% defoaming surfactant, from about 0.001 wt-% to about 30 wt-% defoaming surfactant, from about 0.005 wt-% to about 20 wt-% defoaming surfactant, from about 0.01 wt-% to about 15 wt-% defoaming surfactant, from about 1 wt-%-to about 30 wt-% defoaming surfactant, or preferably from about 0.1 wt-% to about 15 wt-% defoaming surfactant. In addition, without being limited according to the invention, all ranges recited are inclusive of the numbers defining the range and include each integer within the defined range.

Additional Functional Ingredients

The components of the cleaning compositions can further be combined with various additional functional ingredients suitable for use in ware wash and laundry applications. In some embodiments, the cleaning composition including the optional alkalinity source and the long chain polyamine make up a large amount, or even substantially all of the total weight of the cleaning composition. In other embodiments, the cleaning composition including the alkalinity source and the long chain polyamine make up a large amount, or even substantially all of the total weight of the cleaning composition. For example, in some embodiments few or no additional functional ingredients are disposed therein.

In other embodiments, additional functional ingredients may be included in the cleaning compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash applications. However, other embodiments may include functional ingredients for use in other applications.

In preferred embodiments, the compositions do not include phosphorous and/or phosphorous based acids. In preferred embodiments, the compositions do not include phosphorous and/or phosphates. In additional preferred embodiments, the compositions do not include quaternary ammonium compounds, including surfactants. In further preferred embodiments, the compositions do not include polyethyleneimines (PEI). PEIs (and modified PEIs) are materials composed of ethylene imine units —$CH_2CH_2NH$— and, where branched, the hydrogen on the nitrogen is replaced by another chain of ethylene imine units.

In other embodiments, the compositions may include cleaning and/or defoaming surfactants, defoaming agents, anti-redeposition agents, water conditioning polymers, bleaching agents, solubility modifiers, dispersants, rinse aids, metal protecting agents, stabilizing agents, corrosion inhibitors, enzymes, fillers, sequestrants and/or chelating agents, including phosphonates, fragrances and/or dyes, rheology modifiers or thickeners, hydrotropes or couplers, buffers, solvents and the like.

Surfactants

In some embodiments, the compositions can include at least one surfactant. Surfactants suitable for use with the compositions of the present invention include, but are not limited to, nonionic surfactants, anionic surfactants, cationic surfactants and zwitterionic surfactants. In some embodiments, the compositions include between about 0 wt-% to about 25 wt-% of a surfactant. In other embodiments the compositions include about 0 wt-% to about 5 wt-% of a surfactant. In addition, without being limited according to the invention, all ranges recited are inclusive of the numbers defining the range and include each integer within the defined range.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water-soluble compound having the desired degree of balance between hydrophilic and hydrophobic properties. Useful nonionic surfactants include:

Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Lutensol™, Dehydol™ manufactured by BASF, Neodol™ manufactured by Shell Chemical Co. and Alfonic™ manufactured by Vista Chemical Co.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

Compounds modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

The alkylphenoxypolyethoxyalkanols of U.S. Pat. No. 2,903,486 issued Sep. 8, 1959 to Brown et al. and represented by the formula

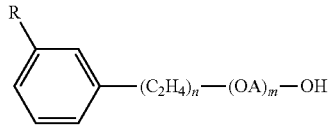

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof, $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the C6-Cis ethoxylated fatty alcohols with a degree of ethoxylation of from 3 to 50.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

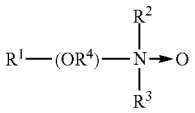

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-triioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

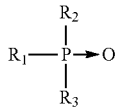

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

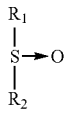

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

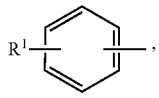

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

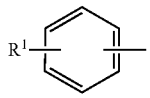

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a C9 alkylaryl polyethoxy (10) carboxylic acid (Witco Chemical). Carboxylates are also available from Clariant, e.g. the product Sandopan® DTC, a C13 alkyl polyethoxy (7) carboxylic acid.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably refer to compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

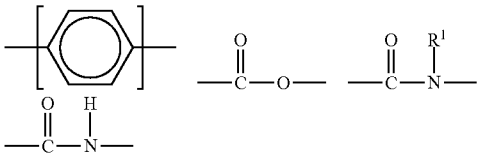

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is can be a group including, but not limited to:

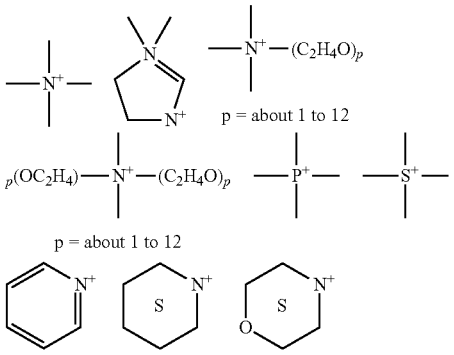

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

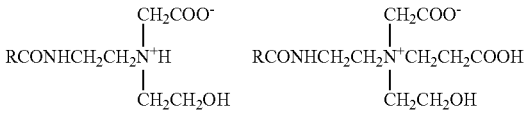

(MONO)ACETATE (DI)PROPIONATE

Neutral pH Zwitterion

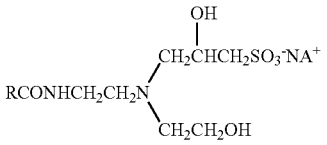

AMPHOTERIC SULFONATE wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

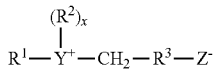

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

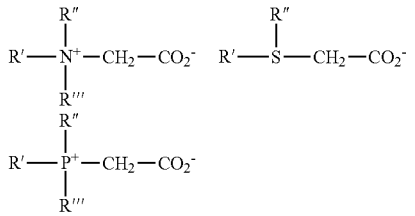

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R_2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated in their entirety.

Defoaming Agent

The compositions and methods of the invention can optionally include a defoaming agent. Defoaming agents can be particularly suitable for embodiments including foaming surfactants, such as anionic surfactants. Generally, defoamers which can be used include silica and silicones; aliphatic acids or esters; alcohols; sulfates or sulfonates; amines or amides; halogenated compounds such as fluorochlorohydrocarbons; vegetable oils, waxes, mineral oils as well as their sulfonated or sulfated derivatives; fatty acids and/or their soaps such as alkali, alkaline earth metal soaps; and phosphates and phosphate esters such as alkyl and alkaline diphosphates, and tributyl phosphates among others; and mixtures thereof.

In some embodiments, the compositions can include antifoaming agents or defoamers which are of food grade quality given the application of the method of the invention. To this end, one of the more effective antifoaming agents includes silicones. Silicones such as dimethyl silicone, glycol polysiloxane, methylphenol polysiloxane, trialkyl or tetralkyl silanes, hydrophobic silica defoamers and mixtures thereof can all be used in defoaming applications. Commercial defoamers commonly available include silicones such as ARDEFOAM™ from Armour Industrial Chemical Company which is a silicone bound in an organic emulsion; FOAM KILL™ or KRESSEO™ available from Krusable Chemical Company which are silicone and non-silicone type defoamers as well as silicone esters; and ANTI-FOAM A™ and DC-200 from Dow Corning Corporation which are both food grade type silicones among others.

Enzymes

In some embodiments, the compositions may further include enzymes. Preferably in the cleaning compositions that do not include an alkalinity source enzymes and water make up a large amount of the cleaning composition.

Since enzymes are proteins, it is important that the other components of the composition not serve to denature the enzyme thus rendering it ineffective for its intended purpose. For preferred cleaning compositions incorporating active enzymes or enzymes otherwise stabilized, the pH of the composition is important. That is, the pH of a composition including an enzymatic should be such that the enzymatic component remains stable and is not denatured. Such a pH may be at or near about neutral pH or between about 7 and 8.

Amylases are examples of enzymes useful in the cleaning compositions. Examples of amylases which can be used are the alpha-amylases from *Bacillus licheniformis*, from *B. amyloliquiefaciens* or *B. stearothermophilus* and developments thereof which have been improved for use in washing and cleaning compositions. Novozymes and Genencor sell commercially-available alpha-amylases derived from one or all of the above-mentioned bacterial species. Novozymes further offers alpha-amylase from *Aspergillus niger* and *A. oryzae*.

Proteases are examples of enzymes useful in the cleaning compositions. Protease can be derived from a microorganism, such as a yeast, a mold, or a bacterium. An example of proteolytic enzyme which can be employed in the cleaning composition include Savinase. Protease derived from *Bacillus lentus, Bacillus licheniformis, Bacillus amyloliquefaciens, Bacillus alcalophilus*, are commercially-available from Genencor International, Solvay Enzymes, Novozymes, and the like.

Preferred enzymes provide good protein removal and cleaning performance, will not leave behind a residue, and will be easy to formulate with and form stable products. For example, Savinase, commercially available from Novozymes, is a serine-type endo-protease and has activity in a pH range of 8 to 12 and a temperature range from 20 C to 60 C. As a further example, Alcalase, commercially available from Novozymes, is derived from *Bacillus licheniformis* and has activity in a pH range of 6.5 to 8.5 and a temperature range from 45 C to 65 C. Esperase is commercially available from Novozymes, is derived from *Bacillus* sp. and has an alkaline pH activity range and a temperature range from 50 C to 85 C.

Mixtures of different enzymes may be incorporated into the cleaning compositions. While various specific enzymes have been described above, it is to be understood that any protease which can confer the desired proteolytic activity to the composition may be used. Compositions of the invention include from about 0 wt-% to about 25 wt-% enzyme, from about 0.0005 wt-% to about 15 wt-% enzyme, from about 0.001 wt-% to about 10 wt-% enzyme, from about 0.001 wt-% to about 5 wt-% enzyme, from about 0.001 wt-%-to about 1 wt-% enzyme. In addition, without being limited according to the invention, all ranges recited are inclusive of the numbers defining the range and include each integer within the defined range.

Chelants

In some embodiments, the compositions may further include a chelant. Chelation herein means the binding or complexation of a bi- or multidentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant.

Suitable aminocarboxylic acid type chelants include the acids, or alkali metal salts thereof. Some examples of aminocarboxylic acid materials include amino acetates and salts thereof. Some examples include the following: N-hydroxyethylaminodiacetic acid; hydroxyethylenediaminetetraacetic acid, nitrilotriacetic acid (NTA); ethylenediaminetetraacetic acid (EDTA); N-hydroxyethylethylenediaminetriacetic acid (HEDTA); diethylenetriaminepentaacetic acid (DTPA); and alanine-N,N-diacetic acid; and the like; and mixtures thereof. Particularly useful aminocarboxylic acid materials containing little or no NTA and no phosphorus include: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), aspartic acid-N,N-diacetic acid (ASDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2,2'-iminodisuccinic acid (HIDS) and other similar acids having an amino group with a carboxylic acid substituent.

Other chelants include amino carboxylates include ethylenediamine tetra-acetates, N-hydroxyethylethylenediaminetriacetates, nitrilo-triacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein. Suitable chelating agents include amino carboxylates, amino phosphonates, polyfunctionally-substituted aromatic chelating agents and mixtures thereof. Exemplary chelants include amino acids based chelants and preferably citrate, tartrate, and glutamic-N,N-diacetic acid and derivatives and/or phosphonate based chelants.

Other chelants include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts, such as sodium sulfate.

Other chelants include a polycarboxylic acid polymers. Representative polycarboxylic acid polymers suitable for the rinse composition include amino carboxylic acids, water soluble acrylic polymers, polymaleic homopolymers, maleic polymers, among others to condition the rinse solutions under end use conditions. Such polymers include polyacrylic acid, poly-methacrylic acid, acrylic acid-methacrylic acid copolymers, hydrolyzed polyacrylamide, hydrolyzed methacrylamide, hydrolyzed acrylamide-methacrylamide copolymers, hydro-lyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used.

In addition, phosphonic acid salts or phosphonate sequestrants may also be employed. In some embodiments, the phosphonic acid salts and/or phosphonate sequestrants may be employed alone, without the polycarboxylic acid polymers. Such useful phosphonic acids include, mono, di, tri and tetraphos-phonic acids which can also contain groups capable of forming anions under alkaline conditions such as carboxy, hydroxy, thio and the like.

Water Conditioning Polymers

In an embodiment the compositions optionally include water conditioning polymer(s). In some aspects a water conditioning polymer is a secondary builder or scale inhibitor for the compositions. According to an embodiment, the water conditioning polymer may be a non-phosphorus polymer. In an aspect, the water conditioning polymer is a nonionic surfactant. In an aspect, the water conditioning polymer is a polycarboxylic acid and/or a hydrophobically modified polycarboxylic acid. An exemplary polyacrylic acid is commercially-available as Acusol® 445N (Dow Chemical). In a further embodiment, a neutralized polycarboxylic acid polymer is employed as the water conditioning polymer. An exemplary neutralized polycarboxylic acid is commercially-available as Acumer® 1000 (Rohm & Haas Company).

In a further aspect, the water conditioning polymer can include a polycarboxylates or related copolymer. Polycarboxylates refer to compounds having a plurality of carboxylate groups. A variety of such polycarboxylate polymers and copolymers are known and described in patent and other literature, and are available commercially. Exemplary polycarboxylates that can be used as builders and/or water conditioning polymers include, but are not limited to: those having pendant carboxylate ($—CO_2^-$) groups such as acrylic homopolymers, polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. In a further aspect, polycarboxylates that can be used as builders and/or water conditioning polymers include, but are not limited to: homopolymers and copolymers of polyacrylates; polyacrylates; polymethacrylates; noncarboxylated materials such as polyolefinic and polymaleic copolymers, such as olefinic and maleic hydride copolymers; and derivatives and salts of all of the same. Additional description of exemplary polycarboxylates and polyacrylates is provided in U.S. Pat. Nos. 7,537,705 and 3,887,806.

In a further aspect, the water conditioning polymer can include a polyacrylate or related copolymer. Suitable polyacrylates, homopolymers and copolymers of polyacrylates, polyolefinic and polymaleic systems according to the invention may include organic compounds, including both polymeric and small molecule agents, including for example polyanionic compositions, such as polyacrylic acid compounds. Polymeric agents commonly comprise polyanionic compositions such as polyacrylic acid compounds. For example, exemplary commercially available acrylic-type polymers include acrylic acid polymers, methacrylic acid polymers, acrylic acid-methacrylic acid copolymers, and water-soluble salts of the said polymers. These include polyelectrolytes such as water soluble acrylic polymers such as polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, hydrolyzed methacrylamide, hydrolyzed acrylamide-methacrylamide copolymers, and combinations thereof. Such polymers, or mixtures thereof, include water soluble salts or partial salts of these polymers such as their respective alkali metal (for example, sodium or potassium) or ammonium salts can also be used.

For a further discussion of water conditioning polymers, see Kirk-Othmer, Encyclopedia of Chemical Technology, Third Edition, volume 5, pages 339-366 and volume 23, pages 319-320, the disclosure of which is incorporated by reference herein.

Methods of Cleaning

The methods of cleaning are particularly well suited for removing lip cosmetic soils. While not wanting to be held to a scientific theory, it is believed that the hydrophobic portion of the lip cosmetic soils make the soil particularly difficult to remove from ware. The hydrophobic portion of the lip cosmetic may be an oil, a viscous solid, or a wax, depending on the desired consistency of the final product. For example, a lip gloss that is rolled onto the lips will tend to be more liquid in consistency than a lip gloss that is applied using a fingertip. Naturally, one would expect the roll on lip gloss to have a higher oil content than a fingertip lip gloss, which would have more solids or waxes. The hydrophobic component of lip cosmetics may be natural or synthetic. The following is a list of non-limiting examples of hydrophobic materials that are found in lip cosmetics: apple (*Pyrus Malus*) peel wax, avocado (*Persea Gratissima*) wax, bayberry (*Myrica cerifera*) wax, beeswax, candelilla (*Euphorbia cerifera*) wax, canola oil, carnauba (*Copernicia cerifera*) wax, castor oil, ceresin, cetyl alcohol, cetyl esters, cocoa (*Theobroma cacao*) butter, coconut (*Cocos nucifera*) oil, hydrogenated jojoba oil, hydrogenated jojoba wax, hydrogenated microcrystalline wax, hydrogenated rice bran wax, hydrolyzed beeswax, isostearic acid, jojoba butter, jojoba esters, jojoba wax, lanolin oil, lanolin wax, microcrystalline wax, mineral oil, mink wax, montan acid wax, montan wax, olive (*Olea europaea*) oil, orange (*Citrus aurantium dulcis*) peel wax, ouricury wax, oxidized beeswax, oxidized microcrystalline wax, ozokerite, palm kernel wax, paraffin, PEG-6 beeswax, PEG-8 beeswax, PEG-12 beeswax, PEG-20 beeswax, PEG-12 carnauba, petrolatum, petroleum jelly, potassium oxidized microcrystalline wax, rice (*Oryza sativa*) wax, sesame (*Sesamum indicum*) oil, shea butter (*Butyrospermum parkii*), shellac wax, spent grain wax, stearic acid, sulfurized jojoba oil, synthetic beeswax, synthetic candelilla wax, synthetic camauba, synthetic japan wax, synthetic jojoba oil, synthetic wax, and vegetable oil. Additional materials found in lip cosmetics include, for example, silicones, such as dimethicone, along with other pigments, dyes, colorants and fragrances.

It is understood that the compositions disclosed herein are capable of removing lip cosmetic soils having the hydrophobic and other materials described above as well as those not included in the list above.

The methods are particularly well suited for removing lip cosmetic soils that accumulate on any type of ware, namely drinkware surfaces typically found in any commercial, institutional, or consumer location including restaurants, bars, hospitals, nursing homes, domestic (consumer) homes, airlines, cafeterias in schools and businesses, and the like.

The methods of cleaning include contacting a ware or other hard surface in need of removing lip cosmetic soils, including for example lipstick, lip stain, lip gloss, lip balm, and/or chap stick. In an aspect, the ware or hard surface is soiled with a waxy, oily and/or greasy soil. Any means of contacting can be used to place the ware or hard surface in contact with the alkaline cleaning compositions, including for example, soaking, spraying, dripping, wiping, or the like. Included within the scope of contacting described herein, the ware and/or hard surface can also be soaked, including a pretreatment, with the alkaline compositions. As a result of the contacting step the surface is washed and the soils removed.

In certain embodiments a concentrate can be sprayed onto a surface for a hard surface treatment. The contacting time may varying from a few seconds to a few minutes. In other embodiments, a lower concentration of the cleaning compositions may be employed for a presoak application, such as where wares or silverware are soaked before being placed into a warewash machine. In such embodiments the contact time can vary from a few minutes to a few hours (e.g. overnight soak).

In an aspect, the surface is a ware. Exemplary ware include, for example, glass, ceramic, melamine, and/or plastic. Ware washing described herein can be washed manually. In an alternative aspect, the ware is washed in a warewashing machine.

In both warewashing applications, soaking (or pretreatment) applications and/or other hard surface treatment applications, the long chain polyamines can be added to the alkaline composition in a use solution. Alternatively, a fully formulated alkaline cleaning composition can be provided. A first step of diluting and/or creating an aqueous use solution (such as from a solid) can also be included in the methods. An exemplary dilution step includes contacting the liquid and/or solid composition with water.

The alkaline cleaning compositions can be provided at an actives level in a ready to use and/or concentrate composition providing a desired amount of actives of the components of the compositions. In an aspect, the long chain polyamine is provided at a concentration from about 10 ppm to about 200 ppm in a use solution, or from about 100 ppm to about 200 ppm in a use solution.

In an aspect, the alkaline cleaning compositions contacts the wares and/or other hard surface in need of cleaning at a use solution will have a pH of between about 7.5 and about 13.5.

In an aspect, the alkaline cleaning compositions contacts the wares and/or other hard surface for a sufficient amount of time to remove the soils, including from a few seconds to a few hours, including all ranges therebetween. In an embodiment, the composition contacts the wares and/or other hard surface for at least about 15 seconds, at least about 30 seconds, at least about 45 seconds, or at least about 60 seconds. In an embodiment, the composition contacts the wares and/or other hard surface for at least about 1 minute, at least about 2 minutes, at least about 3 minutes, at least about 4 minutes, or at least about 5 minutes.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used in the following examples are provided herein:

Covergirl 435: A commercially available lipstick from Cover Girl Cosmetics.

Covergirl 305: A commercially available lipstick from Cover Girl Cosmetics.

MAC C46: a lipstick from MAC Cosmetic.

Lipstick Tiles: A manufactured glass tile pre-soiled with pink lipstick, from Center for Test materials.

Stainless steel coupon: Commercially available, used for lipstick application.

Ultra Klene: An alkaline industrial and professional machine warewashing detergent containing caustic.

Amine 736: a long chain triamine, N1-(3-aminopropyl)-N3-dodecylpropane-1,3,diamine as shown in Formula I.

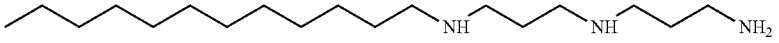

[I]

Amine 739: a long chain pentamine, N1,N1,N3-tris(3-aminopropyl)-N3-dodecylpropane-1,3-diamine as shown in Formula II.

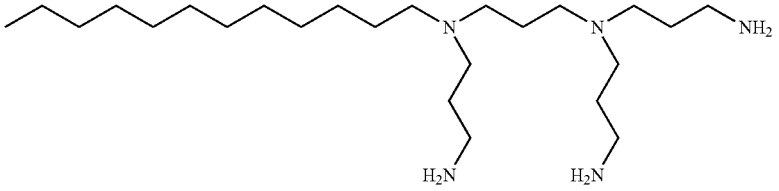

[II]

Amine 754: a long chain cyclic triamine, N1-(3-aminopropyl)-N1-phenethylpropane-1,3-diamine as shown in Formula III.

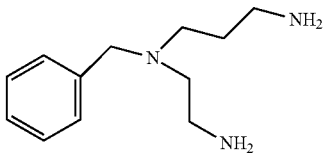

[III]

Amine 757: a long chain triamine, N1-(3-aminopropyl)-N1-benzylpropane-1,3-diamine as shown in Formula IV.

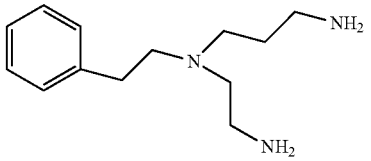

[IV]

Example 1

A 1000 mL beaker was filled with 600 g of cold tap 5 gpg water. 1000 ppm of Formula A and 100 ppm of a long chain polyamine were added and magnetically stirred at 200 RPM for at least 5 minutes to equilibrate. Tables 1 and 2 detail the compositions of each Formula. The experiments were run under ambient conditions.

TABLE 1

Formula A, referred to as 'caustic' or 'C' in FIG. 1 through FIG. 5.

| Raw Material | % |
|---|---|
| Sodium Hydroxide | 50 |
| Water | 50 |
| Total | 100 |

TABLE 2

| Test formulations. | | | | | |
|---|---|---|---|---|---|
| | Formula A | Formula B | Formula C | Formula D | Formula E |
| Long chain polyamine Formula | 1000 ppm | 1000 ppm | 1000 ppm | 1000 ppm | 1000 ppm |
| 736 | | 100 ppm | | | |
| 739 | | | 100 ppm | | |
| 754 | | | | 100 ppm | |
| 757 | | | | | 100 ppm |

On two new glass slides, a lipstick line was drawn the length of the slide. Using binder clips, the two slides were hung from stainless steel hooks opposite each other. While the solution was stirred at 200 RPM, the slides were submerged in the solution, making sure to keep the slides as vertical as possible and not situated in the vortex at the center of the beaker.

The slides were removed and left to air dry after sitting in the solution for 16 hours at ambient temperature. The performance of each formula regarding lipstick pigment and wax removal was then visually evaluated.

No removal of pigment or wax was observed across lipstick brands for formulas A, D, and E, as shown in FIGS. 1A-1C, 2A-2C, and 3A-3C respectively. Each of the figures shows images of the glass slides after treatment with the formulas.

Figure 4A:
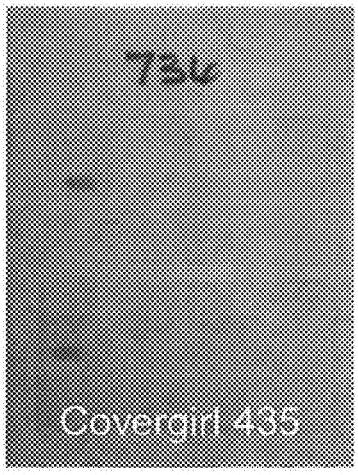
FIG. 4(A-C) shows images from Example 1 of glass slides after treatment with Formula B wherein complete pigment removal and partial wax removal was observed for the Covergirl samples, and the MAC C46 samples showed only partial removal for both pigment and wax.
Figure 4B:
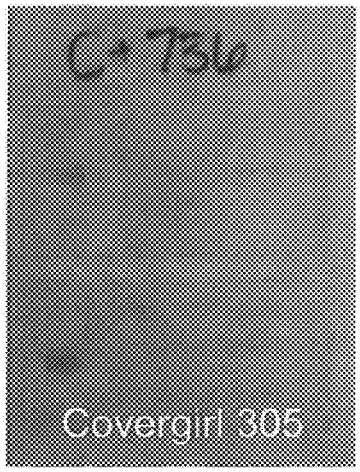
Figure 4C:
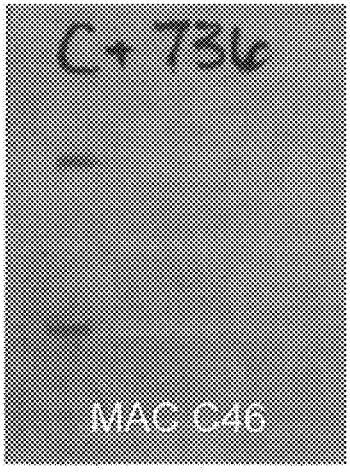

Formula B demonstrated complete pigment removal and partial wax removal for Covergirl 435 and Covergirl 305. The MAC C46 sample had partial pigment and wax removal. The results for Formula B are shown in FIGS. 4A-4C.

Figure 5A:
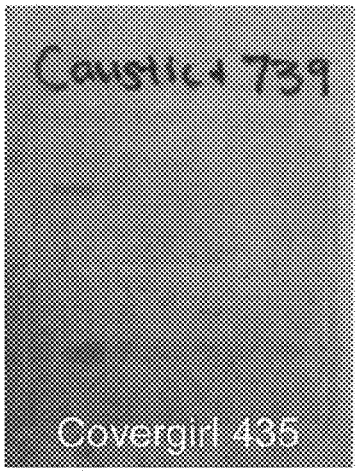
FIG. 5(A-C) shows images from Example 1 of glass slides after treatment with Formula C wherein Covergirl 435 showed complete pigment and partial wax removal in the primary portion of the slide, while Covergirl 305 and MAC C46 were observed to have partial pigment and minimal wax removal.
Figure 5B:
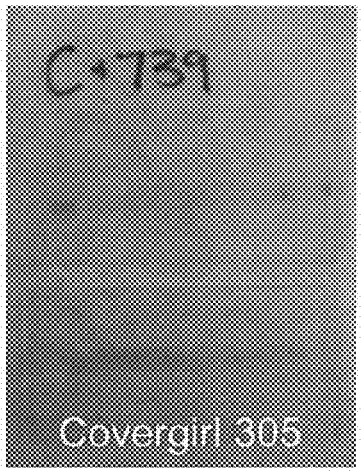
Figure 5C:
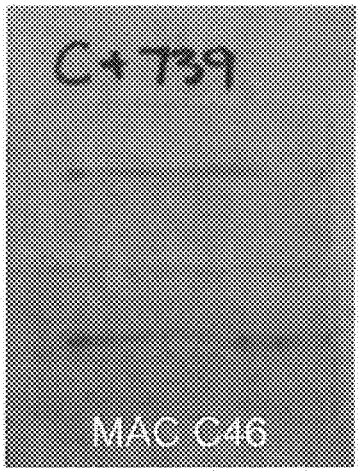

Formula C showed complete pigment and partial wax removal for the Covergirl 435 and Covergirl 305 samples. The MAC C46 sample had some pigment and minimal wax removal. The results for Formula C are shown in FIGS. 5A-5C.

Example 2

A low temperature warewash machine from Ecolab, Inc, with a dish rack was filled with 1.5 gallons of 5 gpg water at 120° F. A pre-soiled lipstick tile was placed on a stainless steel tile holder anchored halfway between the center of the rack and the back left corner, attached with binder clips. The rack was then placed in the warewash machine, the appropriate formula was added per Table 3, and a cycle ran. The cycle was repeated for a total of 50 or 5 cycles, dosing new chemistry each cycle to keep the concentration constant. The warewash machine maintains a water temperature of 120° F. for wash and rinse. Each test was repeated two or three times.

TABLE 3

| Test formulations | | | | | |
|---|---|---|---|---|---|
| | Formula F | Formula G | Formula H | Formula I | Formula J |
| Ultra Klene (hydroxide alkalinity source) | 1000 ppm | 1000 ppm | 1000 ppm | 1000 ppm | 1000 ppm |
| Long chain polyamine 736 | | 100 ppm | | 200 ppm | 500 ppm |

TABLE 3-continued

| Test formulations | | | | | |
|---|---|---|---|---|---|
| | Formula F | Formula G | Formula H | Formula I | Formula J |
| Long chain polyamine 739 | | | 100 ppm | | |
| Defoaming Surfactant | | 200 ppm | 200 ppm | 400 ppm | 1000 ppm |
| Number Cycles | 50 | 50 | 50 | 50 | 5 |

Following the testing, digital images were taken of the tiles using a white background. Using Fiji ImageJ software (an open source image processing package), the image was changed to a 16-bit black and white image with the threshold set to 215. Measurements were taken using ImageJ to determine the percent coverage over a given area on the tile.

Figure 6:
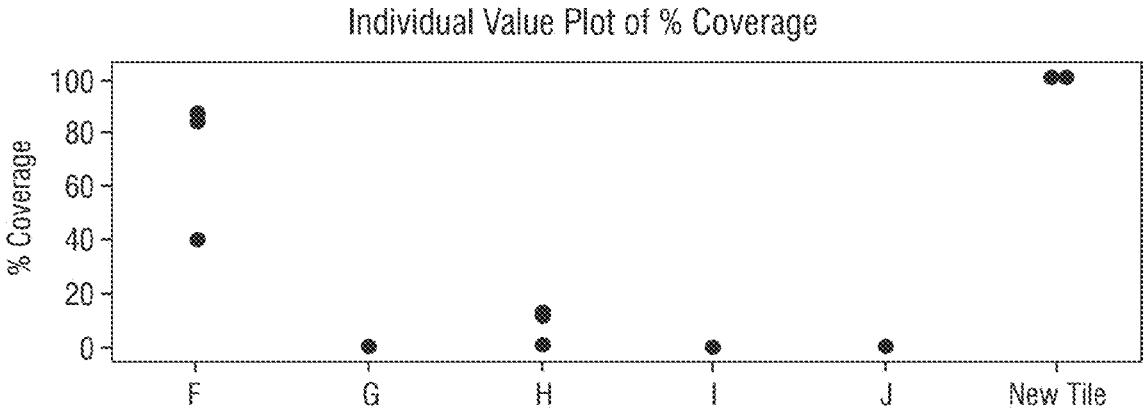
FIG. 6 shows a graphical depiction of percent lipstick remaining with different chemistries from Example 2.
Figure 7:
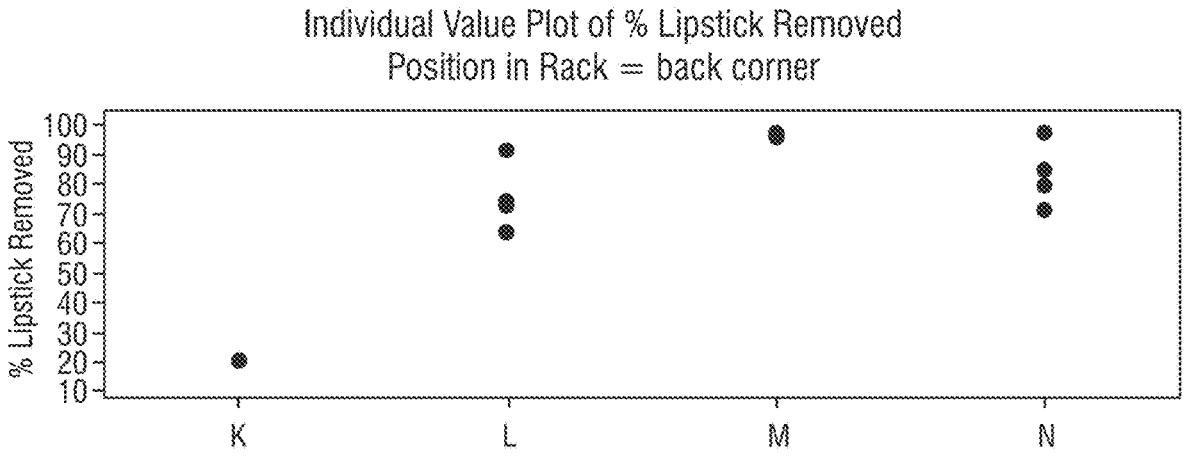
FIG. 7 shows graphical depiction of percent lipstick removed in Example 3 from glasses in the back corner of the dish rack.
Figure 8:
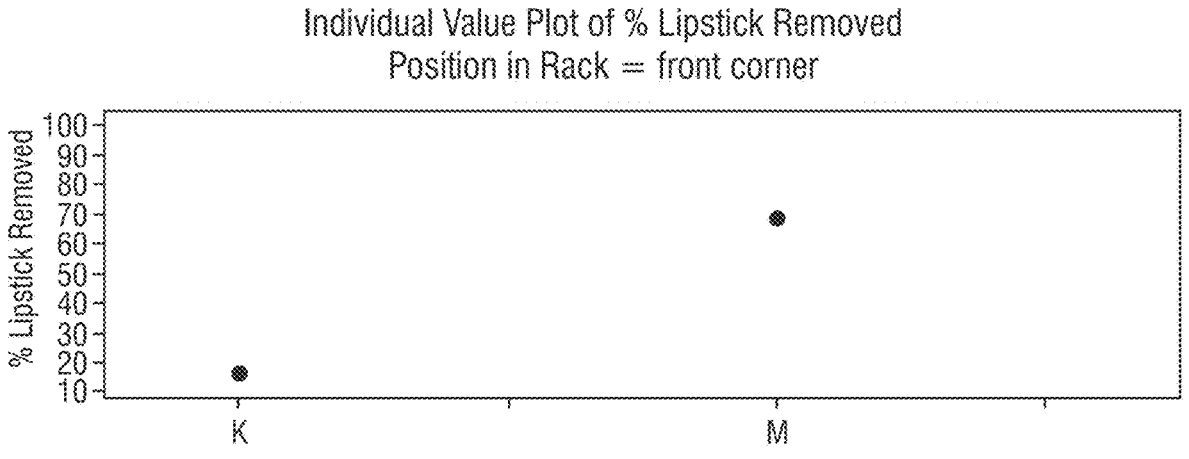
FIG. 8 shows graphical depiction of percent lipstick removed in Example 3 from glasses in the front corner of the dish rack.
Figure 9:
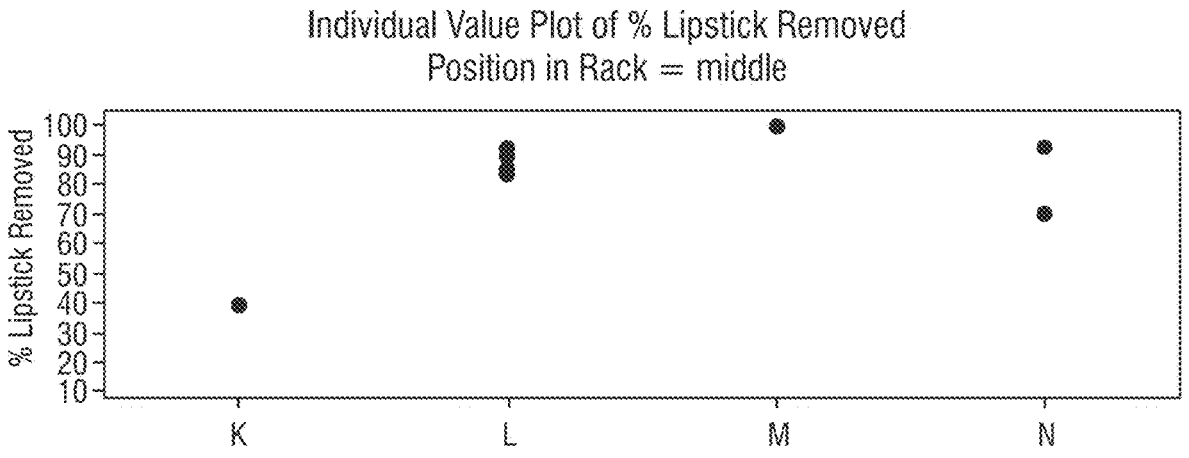
FIG. 9 shows graphical depiction of percent lipstick removed in Example 3 from glasses in the middle position of the dish rack.
Figure 10:
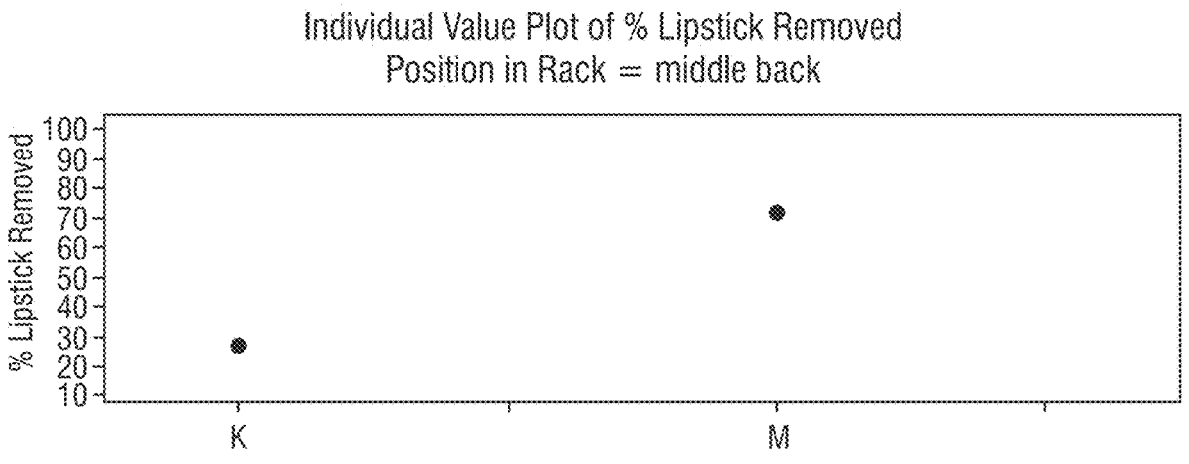
FIG. 10 shows graphical depiction of percent lipstick removed in Example 3 from glasses in the middle back position of the dish rack.
Figure 11:
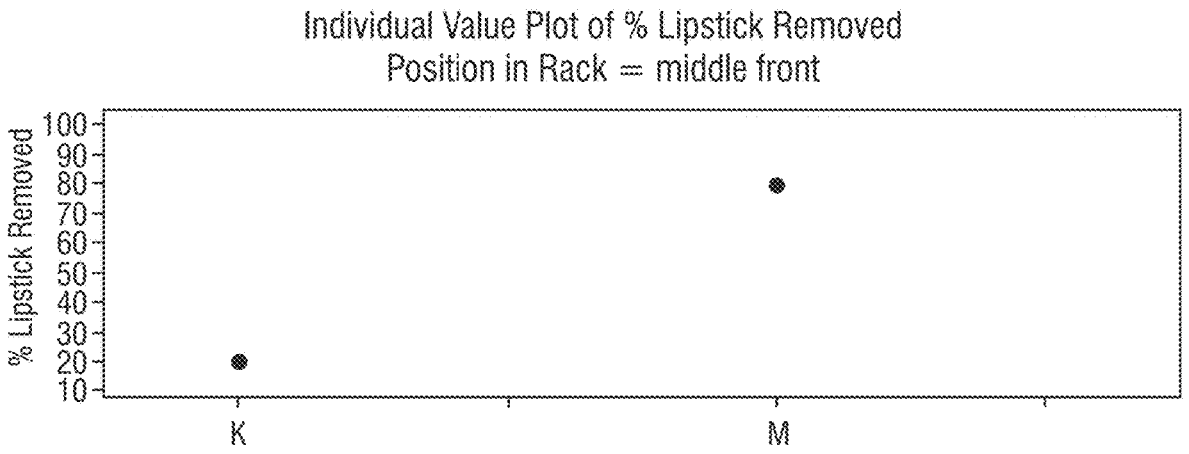
FIG. 11 shows graphical depiction of percent lipstick removed in Example 3 from glasses in the middle front position of the dish rack.

The percent lipstick remaining after testing is shown in FIG. 6, which is a graphical depiction of percent lipstick remaining with evaluated formulations. The lower values denote more lipstick removed. Beneficially the evaluated formulations containing long chain polyamines in the alkaline detergent compositions provide efficacious removal of lip stains from wares.

Example 3

Ordinary drinking glassware were visually examined prior to use for scratches or remaining soil. Those glasses chosen for testing were stamped with Covergirl 435 using a lipstick stamp to which lipstick was applied with a clean stainless steel coupon. The coupon, or other clean edge, was dragged across the stamp in the direction of the stamp ridges until fully coated with ridges remaining visible. The stamp was then pressed against the side of the glass, halfway between the base and the lip. While applying even pressure, a gentle, side-to-side, rocking motion was used before removing the stamp from the glass surface to ensure uniformity of lipstick coverage. The use of the lipstick stamp procedure provides a repeatable and consistent lipstick removal performance evaluation method in an industrial warewash machine.

An image was taken of each glass in a light box with a white background. A Nikon D5300 DSLR with Camera Control Pro 2 software was used with 1/80 second shutter speed and f/2.8 aperture. The glasses were then placed in the front center, middle front, middle, middle back and/or back corner of the warewash rack, with lipstick facing forward. The rack was then placed in an warewash dish machine filled with 1.5 gallons of 17 gpg water at 120° F. The appropriate formula was added per Table 4, and a cycle ran. The cycle was repeated for a total of 25 cycles, dosing new chemistry as needed to keep the concentration constant. The warewash dish machine maintains a water temperature of 120° F. for wash and rinse.

TABLE 4

| Test formulations. | | | | |
|---|---|---|---|---|
| | Formula K | Formula L | Formula M | Formula N |
| Ultra Klene (hydroxide alkalinity source) | 1000 ppm | 1000 ppm | 1000 ppm | 1000 ppm |

TABLE 4-continued

Test formulations.

| | Formula K | Formula L | Formula M | Formula N |
|---|---|---|---|---|
| Pluronic N3 | | 100 ppm | 200 ppm | 20 ppm |
| Long chain polyamine 736 | | 50 ppm | 100 ppm | 10 ppm |
| Number Cycles | 25 | 25 | 25 | 25 |

After the test was completed, the glasses were removed from the rack, air dried, and re-imaged in the light box using the same procedure as before testing. Fiji's ImageJ software was used to measure the amount of pigment/lipstick removed. Each image was opened in ImageJ and, under the image tab, the image type changed to black and white and the threshold adjusted to 152. A macro was used to ensure the same area of exactly 553152 square pixels was measured in each sample, before and after testing.

The rectangle was adjusted to contain the stamped lipstick, and a percent area measurement recorded. The pre- and post-treatment percent area measurements were used to calculate the amount of pigment removed. The percent of lipstick removed for each rack position is shown in FIGS. 7-11.

Example 4

Additional testing of lip stick stain removal from glass tiles was performed. Pre-soiled pink lipstick on glass tiles were obtained from the Center for Test materials BV—The Netherlands. Testing was completed on the ES2000 low temperature machine with 5 gpg water. The fill volume was 1.5 gallons and the incoming water temperature was 120° F. The soiled tiles were placed on the stainless steel tile holder anchored halfway between the center of the rack and the back left corner of the machine, and attached with binder clips. The appropriate formula was added per Table 5, and a complete wash and rinse cycle was ran. The cycle was repeated for a total of 50 cycles, dosing new chemistry as needed to keep the concentration constant.

TABLE 5

Test formulations.

| | Formula M | Formula O |
|---|---|---|
| Ultra Klene (hydroxide alkalinity source) | 1000 ppm | 0 ppm |
| Pluronic N3 | 200 ppm | 200 ppm |
| Long chain polyamine 736 | 100 ppm | 100 ppm |
| Number Cycles | 50 | 50 |

Figure 12:
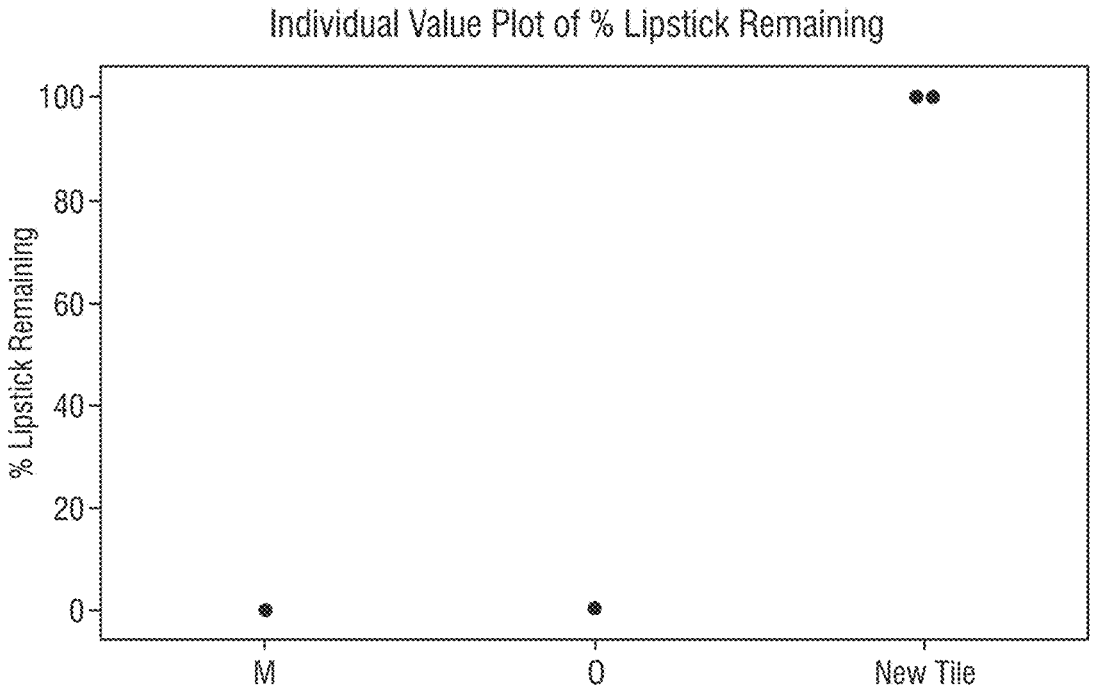
FIG. 12 shows graphical depiction of percent lipstick removed in Example 4 from lipstick tiles.

After the test was completed, the glass tiles were removed from the rack, air dried, and images collected using a color scanner with a white background. Fiji's ImageJ software was used to measure the amount of pigment/lipstick removed. Each image was opened in ImageJ and, under the image tab, the image type changed to black and white and the threshold adjusted to 215. A macro was used to ensure the same area was analyzed and measured in each sample. FIG. 12 shows the results where the composition including the long chain polyamines, namely C6-C20 polyamines with and without alkalinity sources performed equally well to remove the lipstick stains.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

What is claimed is:

1. A cleaning composition comprising:

an optional alkalinity source which is an alkali metal hydroxide, alkali metal carbonate, alkali metal silicate, and/or an organic nitrogen base;

at least one of a cleaning and/or defoaming surfactant, solvent, polymer, chelant, or enzyme; and a C6-C20 long chain polyamine comprising N1,N1,N3-tris(3-aminopropyl)-N3-dodecylpropane-1,3-diamine and/or N1-(3-aminopropyl)-N3-dodecylpropane-1,3, diamine.

2. The composition of claim 1, wherein the alkalinity source is an alkali metal hydroxide.

3. The composition of claim 1, wherein the long chain polyamine further comprises a C6-C18 polyamine.

4. The composition of claim 1, wherein the long chain polyamine is N1-(3-aminopropyl)-N3-dodecylpropane-1,3, diamine.

5. The composition of claim 1, wherein the composition further comprises at least one additional functional ingredient comprising hydrotropes, dyes, viscosity modifiers, or fillers.

6. The composition of claim 1, wherein the cleaning and/or defoaming surfactant comprises an alkoxylated nonionic surfactant, polyoxypropylene-polyoxyethylene polymeric compound, and/or reverse polyoxypropylene-polyoxyethylene polymeric compound.

7. A cleaning composition comprising:

an optional alkali metal hydroxide;

a C6-C20 long chain polyamine comprising N1,N1,N3-tris(3-aminopropyl)-N3-dodecylpropane-1,3-diamine and/or N1-(3-aminopropyl)-N3-dodecylpropane-1,3, diamine;

a defoaming surfactant; and water.

8. The composition of claim 7, wherein the composition comprises from about 1 wt-% to about 99 wt-% of the composition of the alkali metal hydroxide, and from about 0.0005 wt-% to about 50 wt-% of the composition of the long chain polyamine.

9. The composition of claim 7, wherein the composition further comprises at least one additional functional ingredient comprising surfactants, hydrotropes, dyes, viscosity modifiers, chelants, polymers, enzymes, fillers, or solvents.

10. The composition of claim 7, wherein the defoaming surfactant comprises an alkoxylated nonionic surfactant, polyoxypropylene-polyoxyethylene polymeric compound, and/or reverse polyoxypropylene-polyoxyethylene polymeric compound.

11. The composition of claim 7, further comprising a polymer and/or solvent.

12. A method of removing waxy, oily and/or greasy soils comprising:

contacting a ware with the cleaning composition of claim 1, wherein the ware is soiled with a waxy, oily, and/or greasy soil; and washing the ware.

13. The method of claim 12, wherein the soil is a lip cosmetic soil.

14. The method of claim 13, wherein the lip cosmetic soil comprises at least one of lipstick, lip stain, lip gloss, lip balm, or chapstick.

15. The method of claim 12, wherein the ware is glass, ceramic and/or plastic.

16. The method of claim 12, wherein the ware is washed manually, washed in a warewashing machine, or soaked in a container with the cleaning composition.

17. The method of claim 12, wherein the cleaning composition is diluted with water to form a use solution prior to contacting with the ware.

18. The method of claim 17, wherein the long chain polyamine is provided at a concentration from about 10 ppm to about 200 ppm in the use solution.

19. The method of claim 12, wherein the cleaning composition has a pH of between about 7.5 and about 13.5.

* * * * *